US011786795B2

(12) United States Patent
Dunn

(10) Patent No.: US 11,786,795 B2
(45) Date of Patent: Oct. 17, 2023

(54) SLOW-PITCH SOFTBALL STRIKE-INDICATING MAT

(71) Applicant: Russell Brooke Dunn, Henderson, NV (US)

(72) Inventor: Russell Brooke Dunn, Henderson, NV (US)

( * ) Notice: Subject to any disclaimer, the term of this patent is extended or adjusted under 35 U.S.C. 154(b) by 176 days.

(21) Appl. No.: 17/379,144

(22) Filed: Jul. 19, 2021

(65) Prior Publication Data

US 2023/0015816 A1 Jan. 19, 2023

(51) Int. Cl.

| | |
|---|---|
| ***A63B 71/00*** | (2006.01) |
| ***A63B 71/06*** | (2006.01) |
| ***A63B 69/00*** | (2006.01) |
| ***A63B 24/00*** | (2006.01) |
| *A63B 102/18* | (2015.01) |

(52) U.S. Cl.

CPC ..... *A63B 71/0605* (2013.01); *A63B 24/0021* (2013.01); *A63B 69/0013* (2013.01); *A63B 71/0622* (2013.01); *A63B 2071/0625* (2013.01); *A63B 2071/0658* (2013.01); *A63B 2102/182* (2015.10); *A63B 2220/805* (2013.01)

(58) Field of Classification Search

CPC ..... A63B 71/0605; A63B 24/0021; A63B 71/0622; A63B 2102/182; A63B 2071/0625

USPC ..... 473/500, 497, 499, 451, 452

See application file for complete search history.

(56) References Cited

U.S. PATENT DOCUMENTS

| | | | | |
|---|---|---|---|---|
| 4,309,031 | A * | 1/1982 | O'Meara | A63C 19/00 473/415 |
| 4,972,171 | A * | 11/1990 | Johnson | A63B 69/0002 473/455 |
| 5,069,450 | A * | 12/1991 | Pyle | A63B 63/007 473/415 |
| 8,043,175 | B2 * | 10/2011 | Chen | A63B 71/0605 473/456 |
| 8,591,356 | B2 * | 11/2013 | Walker | A63B 71/0605 473/456 |
| 9,352,208 | B2 * | 5/2016 | Davis | A63B 71/0605 473/499 |
| 2010/0248853 | A1 * | 9/2010 | Dellinger | A63B 69/3614 473/453 |
| 2023/0015816 | A1 * | 1/2023 | Dunn | A63B 71/0622 473/500 |

* cited by examiner

*Primary Examiner* — Mitra Aryanpour

(74) *Attorney, Agent, or Firm* — Mark A. Litman & Associates, P.A.

(57) ABSTRACT

A sensing system and method determines whether a slow pitch softball has been delivered in a strike zone. The system includes: a dual, mirror image slow-pitch software home plate; the home plate having an upper surface and a lower surface; the lower surface configured for attachment to ground; the upper surface comprising a pressure or impact sensing array covering at least edges of the upper surface of the home plate; the sensing array having a battery source for powering the system; the sensing array issuing an electrical signal when sensing pressure or impact; and the electrical signal connected to an audio or visual output device that indicates receiving of the electrical signal by a visual or audio emission.

7 Claims, 3 Drawing Sheets

SLOW-PITCH SOFTBALL STRIKE-INDICATING MAT

BACKGROUND OF THE INVENTION

1. Field of the Invention

The present invention relates to the field of slow-pitch softball and equipment useful to improve accessibility and interest in the game.

2. Background of the Art

The game of slow-pitch softball has many similarities to the more widely played competitive games of hardball (commonly just referred to as baseball) and fast-pitch softball which is played at the collegiate level. The slow-pitch game has increased in popularity where it has become a popular social and business sport with communities and groups competing on a friendly basis against each other. The game still requires umpires to make calls, especially strikes and balls at home plate. The rules of the game differ from the other more common ball variants and include the following.

Slow-Pitch Softball Rules

S0. Official Rules: The rules presented for GSC Slow Pitch Softball are not meant to be complete. If a situation arises that is not explicitly covered by either the general rules or the rules for slow pitch softball, the Official Softball Playing Rules (for slow pitch softball) as adopted by the Amateur Softball Association of America shall govern the situation. Local Rules may be added or deleted from the Official Rules to accommodate size of field, number of players, availability of lights, time limits and other restrictions.

S1. Number of Players: No more than 10 defensive players are allowed on the field at one time. There is no maximum number of players for the batting order—all players bat.

S2. Pitch Arc: The maximum arc of a pitch must lie between 6 and 12 feet above the ground (some leagues allow unlimited arc). (There are local rules and events where the arc is unlimited and may exceed 12 feet).

The umpire must declare a pitch illegal by shouting "ball" while the pitch is in the air. The batter may still choose to swing at the pitch (a good idea if the pitch arc is low and over the plate). A declared illegal pitch which is hit in play is treated as any other hit pitch. Of course a declared illegal pitch counts as a strike if the batter swings and misses or fouls the pitch off.

S3. Types of Pitches: Any pitch within the arc limits is considered a legal pitch, e.g., top spin, back spin, etc., are all considered legal pitches.

S4. Strike Zone: The strike zone is defined by an extended home plate whose width is the normal plate width and whose depth extends approximately 2.5 feet behind the front of the plate. Any pitch landing partially or wholly in this area is a strike.

S5A. Strikes, Balls, Fouls: The batter is out after a third strike, including a foul ball that is hit after two strikes. This rule is necessary to help ensure that C and D league games complete seven innings within the 75-minute limit.

S5B. There are walks and strikeouts in D league.

S6. No Bunting: Bunting is prohibited.

S7. No Stealing: Base stealing and leading off are prohibited. The base runner must remain on base until the ball is hit. Runners may advance only when the ball is hit within the field of play or when a batter is walked.

S8. Ball in Play: The umpire is supposed to call time-out whenever a defender who is in the infield controls the ball, and in the ump's judgment no more plays can be made.

S9. Extended Home Plate: The extended home plate is used to mark the strike zone. The entire extended home plate is considered to be the legal home plate. If the runner safely touches any portion of the extended home plate, the run scores. If the catcher is in control of the ball and touches any portion of the extended home plate on a force play, the runner attempting to advance to home plate is called out. Revised: Jun. 15, 2003.

Rules may be added or removed on a local level based on various conditions to accommodate the dimensions of the field, number of players, allowing of co-ed players, limitations to allow for age/size/ability of participants, time limits, size of softball, etc.

These rules include disallowing one or more participants from hitting the ball over the fence, number of foul balls allowed prior to being called out, number of pitches allowed per plate appearance, starting count for each at bat (initial count could be 1-1, one ball and one strike, vs 0-0), number of innings and handling of extra innings for games ending in a tie score. This list is not all inclusive.

The rules state in S9—" . . . ball strikes any part of the rectangle encompassing the rectangular plate." The strike zone is the rectangle (imaginary or real, like in a piece of carpet/mat) that is the width and length of the two plates placed point to point. This description is used throughout the document.

A common thread runs through the three related ball games in the personal difficulties in providing consistent calls on balls and strikes. Even Major League Baseball (MLB) has investigated the use of highly accurate strike determination equipment. In slow-pitch softball, a mat is used that is basically a surface area of a standard plate having a mirror image extending towards a catcher. If the high arc ball strikes any part of the two plates, it is considered a strike. Viewing the strike zone is complicated for an umpire as the back mirrored section is nearly completely blocked by the body of the catcher. The plate and strike zone are a rectangle.

The following documentation evidences some of the efforts made in hardball (even MLB) to automate strike calling. Technology including doppler effects, lasers, high efficiency cameras, complex software and other expensive apparatus to accomplish these goals as in U.S. Pat. No. 5,676,607, Laser Beam Strike Zone Indicator; U.S. Pat. No. 6,159,113, Baseball Strike Indicator; U.S. Pat. No. 6,358,164, Strike Zone Indicator Measuring Device; U.S. Pat. No. 6,688,996, Baseball Home Plate with Laser Beams Arrangement; U.S. Pat. No. 7,341,530, Virtual Strike Zone, U.S. Pat. No. 8,043,175, Sensing Home Plate; U.S. Pat. Nos. 8,335,345, and 8,705,700, Tracking an Object with Multiple Asynchronous Cameras; U.S. Pat. No. 8,591,356, Baseball Strike Zone Detection Radar; U.S. Pat. No. 9,352,208, Electronic Home Plate for Baseball and D Softball Games and Method for Automatic Determination of Presence, Position and Speed of a Ball Relative to the Strike Zone; U.S. Pat. No. 10,670,723, Projectile Position Measurement Using Non-Linear Curve Fitting; and U.S. Pat. No. 10,894,198, Systems and Methods for Dynamic and Accurate Pitch Detection.

These systems are expensive, complicated, bulky and require complex electronics and electrical connections. As slow-pitch softball is often played on local and municipal fields, rather than dedicated stadiums, having the logistic support for these systems is unlikely if not infeasible for slow-pitch. Also, these systems would have to be reconfigured and/or redesigned for slow-pitch. The systems cannot be transported easily and would be very expensive for use with the more casual variant of slow-pitch softball.

An alternative method for determining strike zones for slow pitch games is necessary.

SUMMARY OF THE INVENTION

A sensing system and method determines whether a slow pitch softball has been delivered in a strike zone. The system includes: a dual, mirror image slow-pitch softball home plate, including the area within the rectangle surrounding the mirror image plates; the home plate having an upper surface and a lower surface; the lower surface configured for attachment to ground; the upper surface comprising a pressure or impact sensing array covering at least edges of the upper surface of the home plate; the sensing array having a battery source for powering the system; the sensing array issuing an electrical signal when sensing pressure or impact; and the electrical signal connected to an audio or visual output device that indicates receiving of the electrical signal by a visual or audio emission.

DETAILED DESCRIPTION OF THE INVENTION

A sensing system determines whether a softball has been delivered in a strike zone during play of a game of slow pitch softball. The system may include:

a. a rectangular or dual, mirror image slow-pitch softball home plate;
b. the home plate having an upper surface and a lower surface;
c. the lower surface configured for attachment to ground;
d. the upper surface comprising a pressure or impact sensing array covering at least edges of the upper surface of the home plate;
e. the sensing array having a battery source for powering the system;
f. the sensing array issuing an electrical signal when sensing pressure or impact; and
g. the electrical signal connected to an audio or visual output device that indicates receiving of the electrical signal by a visual or audio emission.

The sensing system may act wherein, once the audio or visual output is triggered, the output persists for at a period of time so that the indicator can be heard and/or seen by the umpire and/or participants, approximately one second. The sensing system may act wherein, once the audio or video output is triggered, the output persists for at least one second. The output may automatically terminate, or if a long-term persistence is required, there may be a WiFi, infrared, wired or other remote signal from the umpire. A receptor on the home plate may even be controlled by an app in the umpire's smart phone. To prevent malicious interference plate receptors should be allowed connection with only one emitter (e.g., phone) at a time, using an encryption between the plate and the phone for security. The encryption may time out after a reasonable game interval, such as four hours. The battery source comprises a replaceable and rechargeable battery below the upper surface. The pressure or impact sensing system covers more than 5%, more than 10%, more than 30% and even more than 90% of area over the upper surface. The sensing system may have LED light emitters in the home plate, and light emitted from the LED light emitters are visible to human eyes for a distance of at least five feet in natural daylight. There may be a cover layer over the pressure or impact sensing array, the cover layer typically being white or colored as is typical with standard of special slow-pitch mats. Some of these mats have decorative markings or functional markings to assist umpires in determining strikes. The system may be used in practice as well as within a game.

A method of identifying a strike in a game of slow pitch softball comprising providing the above-described sensing system 1 at home plate on a slow pitch softball field, detecting that a pitched softball causes pressure on or contact with the pressure or impact sensing array, initiating issuance of an electrical signal to the audio or visual output device indicating sensing of pressure or contact on the pressure or impact sensing array.

Figure 1:
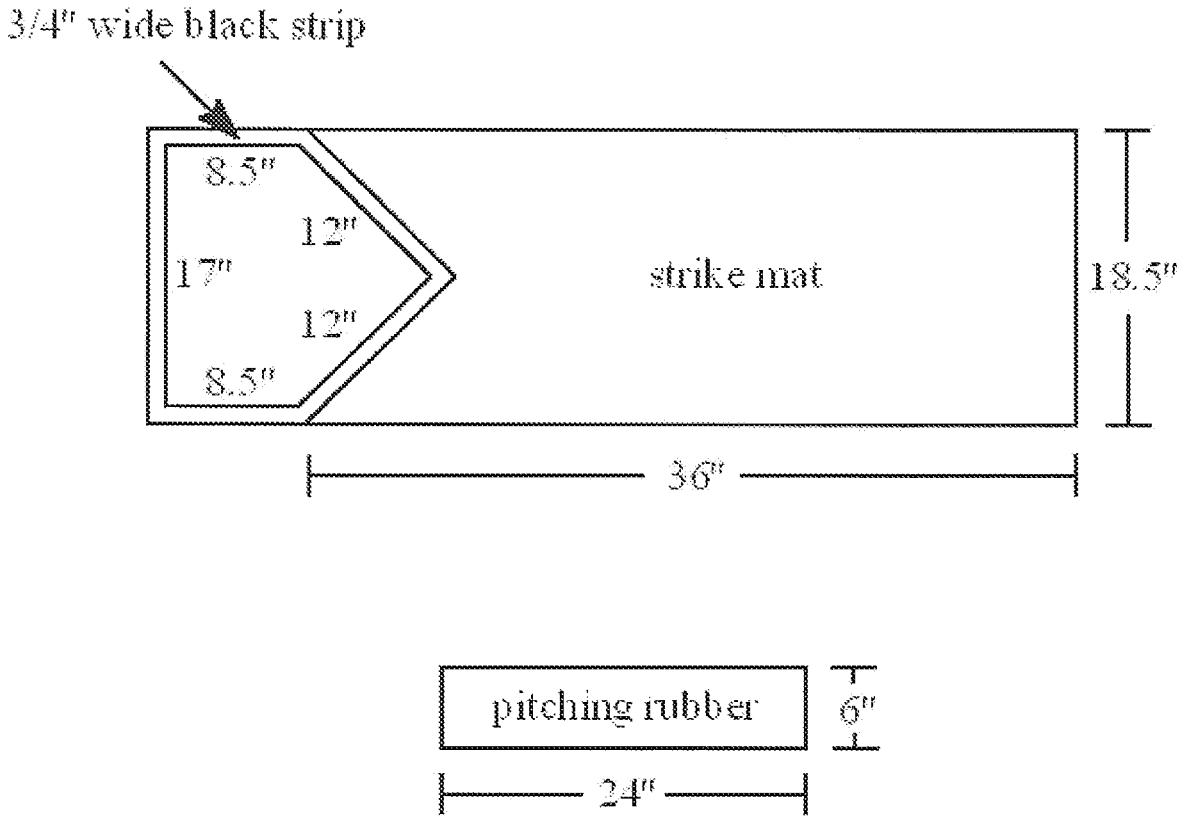
FIG. 1 shows a top view of a mirror-image slow-pitch softball home plate.

FIG. 1 shows a specific size and shape of a softball plate mat. The dimensions may vary according to local custom and rules. For example, the width may be from 12-24 inches and the depth may be from 46 to 60 inches. Larger dimensions could be used with newer or youngers players, and dimensions would decrease with more proficient players. The thickness of the mat may also vary with one's desire for durability and the weight of players using the plate. The plate may be a thin (e.g., 1 mm electronic mat) or a more robust substantive element for heavy usage (e.g., 5 cm thick, not including spikes). The home plate may also be a rectangle of about 18-20 inches wide and 40-50 inches long.

Figure 2:
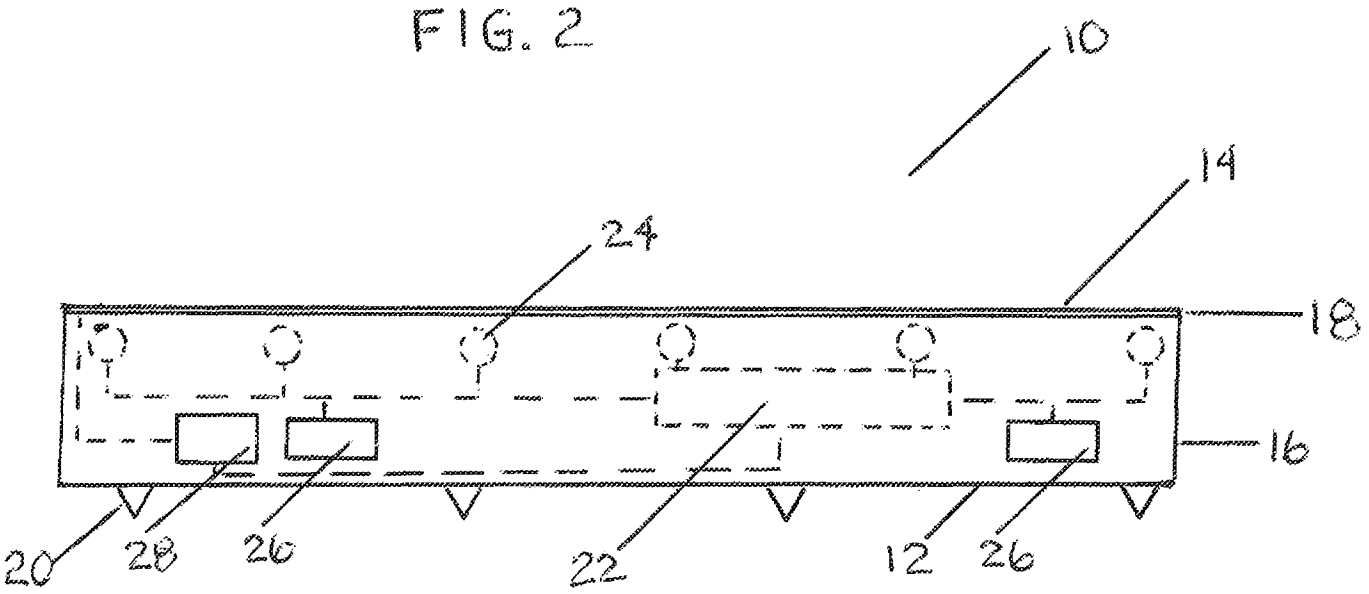
FIG. 2 shows a side view of a home plate sensing device useful in practice of the present invention having a bottom surface connected to ground, a support layer, a pressure or contact sensing layer, a battery, LED lights and a surface cover layer.

FIG. 2 shows a side view of a home plate sensing device 10 useful in practice of the present invention having a top surface 14, bottom surface 12 connected to ground through physical spikes 20, a support layer 16, a pressure or contact sensing layer 18, a battery 22, LED lights 24 and optional sound emitters 26. There is a modest, low level logic circuit (such as a Field programmable Gated Array of FPGA, ASIC or application specific integrated circuit, or chip board etc. in communication with the pressure or contact sensing layer 18, the battery 22, and ultimately to the visual displays (e.g., LED emitters 24) and audio display (e.g., buzzers or speakers 26).

A surface cover layer is optional, but would have to be at least translucent or have holes therein through which the LED emitters could be seen.

Upon impact of contact of a pitched softball with the pressure or contact sensing layer 18, a signal is sent to and received by the low logic element 28, which in turn directs or enables a visual display or audio display to occur. The duration of the relevant display is not critical, as long as it is of sufficient time to be sensed and identified as a signal display by players and the umpire/referee. If sufficiently bright, a millisecond spark emission might be sufficient, although a more durable signal of a half-second, second or more is desirable to assure that everyone has time to see the display. A sound, unless extremely loud (which is not necessarily desirable), should have a substantive duration of at least 0.25 second and preferable more. Shorter and longer periods may be used, as long as they are sufficient to alert players and umpires/officials, and are not so long as to delay the game.

Figure 3:
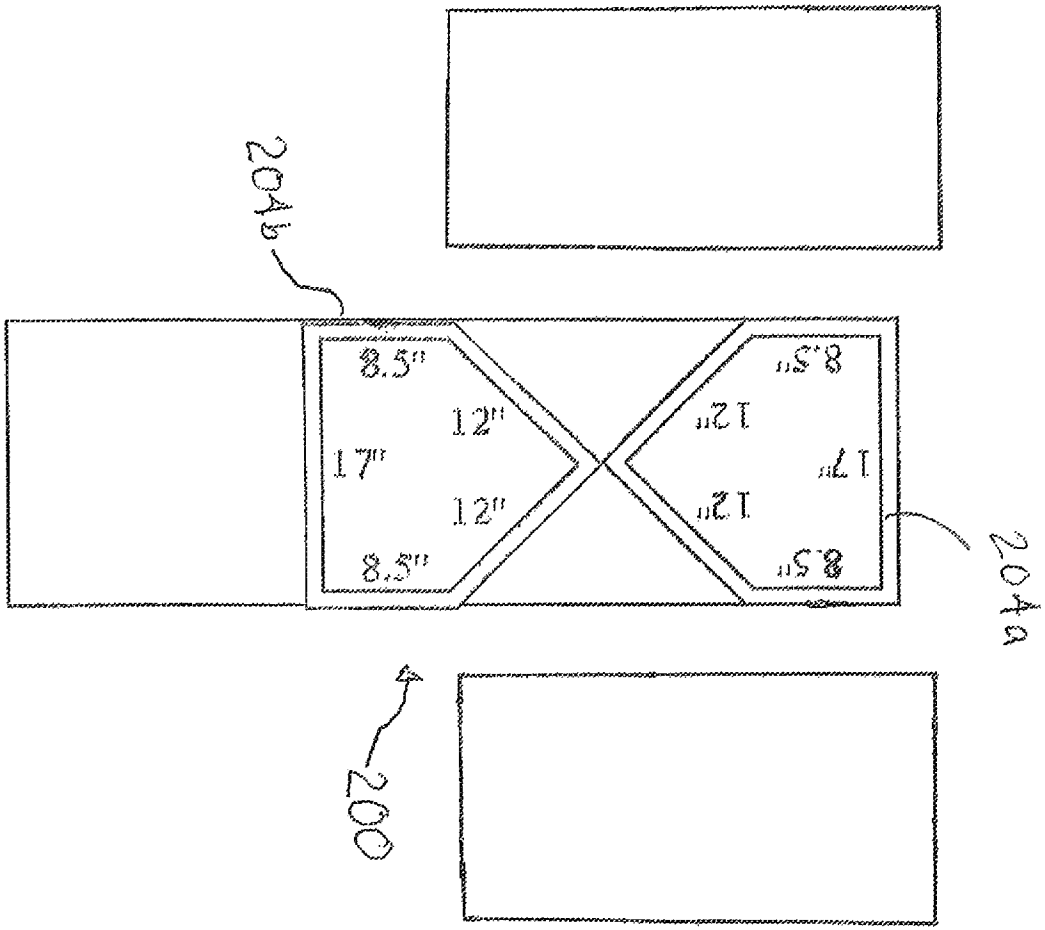
FIG. 3 shows a top view of a mirror-image slow-pitch softball home plate.

FIG. 3 shows a top view of a mirror-image slow-pitch softball home plate 200. There is a forward plate 204*a* and the mirrored rearward plate 204*b*.

The present invention also allows for the umpire to assume a location and position relative to the plate that does not interfere with the catcher, the batter, the pitcher, any other player or the trajectory of the pitch.

What is claimed:

1. A method of identifying a strike in a game of slow pitch softball comprising providing at home plate on a slow pitch softball field a sensing system for determining whether a softball has been delivered in a strike zone during play of a game of slow pitch softball, the system comprising:

a) a dual, mirror image slow-pitch softball home plate area;

b) the minor image slow-pitch softball home plate area having an upper surface and a lower surface;

c) the lower surface configured for attachment to ground;

d) the upper surface comprising a pressure or impact sensing array covering at least edges of the upper surface of the mirror image slow-pitch softball home plate area;

e) the sensing array having a battery source for powering the system;

f) the sensing array issuing an electrical signal when sensing pressure or impact; and g) the electrical signal connected to an audio or visual output device that is triggered to indicate receiving of the electrical signal by a visual or audio emission, the method comprising the sensing system detecting that a pitched softball causes pressure on or contact with the pressure or impact sensing array, and then triggering issuance of an electrical signal to the audio or visual output device indicating sensing of pressure or contact on the pressure or impact sensing array.

2. The method of claim 1 wherein once the audio or visual output is triggered, the audio or video signal persists for at least approximately one second.

3. The method of claim 1 wherein the battery source comprises a replaceable and rechargeable battery below the upper surface and power to the audial or visual output device is from the replaceable and rechargeable battery.

4. The method of claim 1 wherein the pressure or impact sensing system covers more than 30% of area over the upper surface.

5. The method of claim 1 wherein the visual display triggered is from LED light emitters in the home plate, and light emitted from the LED light emitters is visible to human eyes for a distance of at least five feet in natural daylight.

6. The method of claim 1 wherein there is a cover layer over the pressure or impact sensing array.

7. A sensing system for determining whether a softball has been delivered in a strike zone during play of a game of slow pitch softball, the system comprising:

a dual, mirror image slow-pitch softball home plate area;

the home plate having an upper surface and a lower surface;

the lower surface configured for attachment to ground;

the upper surface comprising a pressure or impact sensing array covering at least edges of the upper surface of the home plate;

the sensing array having a battery source for powering the system;

the sensing array issuing an electrical signal when sensing pressure or impact; and the electrical signal connected to an audio or a video signal from a visual output device that indicates receiving of the electrical signal by a visual or audio emission.

* * * * *